US005538443A

United States Patent [19]

Inoue et al.

[11] Patent Number: 5,538,443

[45] Date of Patent: Jul. 23, 1996

[54] BULB SOCKET HAVING EDGES THAT BITE INTO LEADS OF A BULB

[75] Inventors: Nori Inoue; Hitoshi Takanashi, both of Yokkaichi, Japan

[73] Assignee: Sumitomo Wiring Systems, Ltd., Yokkaichi, Japan

[21] Appl. No.: 331,132

[22] Filed: Oct. 28, 1994

[30] Foreign Application Priority Data

Nov. 4, 1993 [JP] Japan ..... 5-301072
Dec. 3, 1993 [JP] Japan ..... 5-071269 U

[51] Int. Cl.[6] ..... H01R 17/00

[52] U.S. Cl. ..... 439/699.2; 439/619

[58] Field of Search ..... 439/619, 699, 439/419

[56] References Cited

U.S. PATENT DOCUMENTS

| | | | |
|---|---|---|---|
| 3,876,896 | 4/1975 | Albrecht et al. | 439/619 |
| 3,910,668 | 10/1975 | Wasmeier . | |
| 5,013,961 | 5/1991 | Reedy | 439/699 |
| 5,018,992 | 5/1991 | Bergin et al. | 439/699 |
| 5,078,625 | 1/1992 | Anzai | 439/699 |
| 5,080,615 | 1/1992 | Kondo | 439/699 |
| 5,209,668 | 5/1993 | Higano et al. | 439/619 |
| 5,286,223 | 2/1994 | Ogawa | 439/699 |

FOREIGN PATENT DOCUMENTS

| | | |
|---|---|---|
| 0545316 | 6/1993 | European Pat. Off. . |
| 1-130290 | 9/1989 | Japan . |
| 2-41387 | 3/1990 | Japan . |
| 2-47782 | 4/1990 | Japan . |
| 1247850 | 9/1971 | United Kingdom . |
| 2145883 | 4/1985 | United Kingdom . |

*Primary Examiner*—P. Austin Bradley
*Assistant Examiner*—Jill DeMello
*Attorney, Agent, or Firm*—Oliff & Berridge

[57] ABSTRACT

A bulb socket has a socket main body and a pair of bulb clamping pieces for holding a base of a bulb. The bulb clamping pieces have projection pieces formed by cutting out and raised up so that not only the base of the bulb is clamped by the bulb clamping pieces by resiliency, but also the edges of the clamping pieces bite into and catch leads raised and bent along the base. Alternatively, a first holding portion and a second holding portion are provided in each of clamping pieces to hold a base of the bulb by way of two-point support by the first and second holding portion of each of the clamping pieces. As a result, the bulb holding force is so increased as to reliably prevent the bulb from being detached from the bulb socket even if the bulb is located at a position susceptible to impact.

9 Claims, 7 Drawing Sheets

BULB SOCKET HAVING EDGES THAT BITE INTO LEADS OF A BULB

BACKGROUND OF THE INVENTION

The invention relates to a bulb socket that feeds power to a wedge base bulb by holding the wedge base bulb, more particularly, to an improved bulb socket that can effectively keep the bulb from being detached therefrom.

A wedge base bulb and a bulb socket to which the wedge base bulb is attached are used, e.g., in a lamp of an automobile. Generally, the bulb socket has a socket main body, and inside the socket main body is a bulb holding chamber that is opened upward to allow the bulb to be accommodated therein. A pair of bulb clamping pieces having resiliency are attached to the inside of the bulb holding chamber so that the base portion of the bulb inserted into the bulb holding chamber can be clamped with resiliency and come in contact with leads extending on the base to electrically connect the bulb socket to the bulb.

For, example, a bulb socket for feeding power by holding a wedge base bulb such as shown in FIG. 1 has heretofore been known. That is, a bulb insertion hole 104 that allows a base portion 103*a* of a wedge base bulb 103 to be inserted thereinto and a connector insertion hole 105 that allows a connector (not shown) to be inserted thereinto are arranged on the upper side and on the lower side of the main body 102 of a bulb socket 101. Holding metals 106, each holding the base portion 103*a* of the wedge base bulb 103 and supplying power thereto, are attached to both sides of the bulb insertion hole 104 on the upper side. Each holding metal 106 has a terminal 106*a* at a lower portion thereof and holding pieces 106*b* formed by bending the bifurcated portions of the terminal 106*a* inward in the middle. A pair of holding portions 106*c* are formed by further bending the upper portions of the holding pieces 106*b* inward to be given resiliency for clamping the base portion 103*a*.

To attach the wedge base bulb 103 to the thus constructed socket main body 102, the base portion 103*a* is inserted into the bulb insertion hole 104 and then set between the holding portions 106*c*. As a result, the holding portions 106*c* come to clamp the base portion 103*a* by way of single-point support at both left and right sides to allow the wedge base bulb 103 to be attached to the socket main body 102.

However, such conventional structure addresses the problem that the holding strength is weak, because the base portion 103*a* of the wedge base bulb 103 is attached to the socket main body 102 while held by way of single-point support, i.e., only by the holding portions 106*c* of the holding metal 106. As a result, when a strong impact is applied to the wedge base bulb 103, the wedge base bulb 103 is likely to be detached from the socket main body 102 if the wedge base bulb is disposed at a position close to the trunk compartment of an automobile such as at the high mount stop lamp or the license plate lamp, because the impact applied to these lamps is strong and the strength of the socket main body 102 to hold the wedge base bulb 103 is not sufficient.

In addition, although it is conceivable to improve the holding strength by increasing resiliency while using thicker special members at the holding portions, such design is disadvantageous in terms of parts cost.

A conventionally taken measure to this problem is disclosed in Japanese Unexamined Utility Model Publication No. 2-47782. The main portion of the structure disclosed in the above publication is shown in FIG. 2. That is, projected portions c bulge out on both upper surfaces of a base portion b of a bulb a, and resilient retaining pieces f retained by the projected portions c are formed on the inner surface of a bulb holding chamber e of a socket main body d.

However, this structure is characterized as arranging the detached prevention portion (the projected portions c and the resilient retaining pieces f) as well as electrical connection portion (the bulb clamping pieces) separately from each other. Therefore, the internal structure of the socket main body d is complicated, which in turn complicates the mold, thus elevating the cost of manufacture. In addition, a specially specified bulb a with the projected portions c provided must be prepared, which does not meet a requirement of general-purpose structure.

SUMMARY OF THE INVENTION

The present invention has been made in consideration of the aforementioned circumstances and an object of the invention is, therefore, to provide a bulb socket that can hold the bulb reliably without complicating the internal structure of the socket main body.

To achieve the above object, according to a first aspect of the invention, a bulb socket includes bulb clamping pieces attached inside a bulb holding chamber, the clamping pieces clamping a base of a bulb and being connectable to leads extending on the base, the bulb holding chamber being opened to a socket main body. Edges are formed on the bulb clamping pieces, the edges being capable of biting into the leads so that such a movement of the bulb as to allow the bulb to come off the socket main body can be prevented.

Further, the edges may be distal end edges of projected pieces cut and raised from the bulb clamping pieces, the edges may be end edges folded back on the bulb clamping pieces.

Moreover, the edges may be edges of window openings formed in the bulb clamping pieces.

Still further, according to the second aspect of the invention, a bulb socket for holding a wedge base bulb that includes: a holding metal being electrically connected to a terminal; a pair of holding pieces, disposed on the holding metal, for clamping a base portion of the wedge base bulb; and a first holding portion and a second holding portion being disposed on each holding piece and extending in a direction of insertion of the base portion. In such bulb socket, both the first and second holding portions have a center of swing set therebetween with respect to the holding piece, and the second holding portions disposed on a deeper side in terms of the direction of insertion of the base portion are expandable as the base portion is further inserted.

According to the first aspect of the invention, when the base of the bulb is inserted into the bulb holding chamber of the socket main body, the base of the bulb is clamped by the bulb clamping pieces and, at the same time, the edges formed on the bulb clamping pieces, e.g., the end edges cut and raised as projected pieces, the end edges folded back as folded back pieces, or the opening edges formed as the window openings, bite into the leads extending on the base to prevent the base of the bulb from being detached from the socket main body.

The bulb holding force is so increased as to prevent the bulb from coming off the bulb socket even if the bulb is mounted on a place subject to impact. In addition, the edges are formed only by simply machining the bulb clamping pieces. Therefore, an increase in the cost of manufacture can be minimized. Moreover, no modification or addition is necessary on the bulb side, so that the bulb socket is of general-purpose type, which can accommodate any conventional types of bulbs.

According to the second aspect of the invention, when the wedge base bulb is inserted into the bulb socket, both second holding portions disposed at a deep position in terms of the insertion direction are expanded by the base portion having passed through the space between both first holding portions. Thus, the front end of the base portion in terms of the insertion direction is clamped. As a result, each holding piece swings around the center of swing between the corresponding first and second holding portions, which in turn makes the distance between both first holding portions disposed at a shallow position in terms of the insertion direction to narrow and thereby clamps the rear end of the base portion in terms of the insertion direction. That is, the swing of both holding pieces associated with the insertion of the base portion of the wedge base bulb allows both the front end side and the rear end side of the base portion in terms of the insertion direction to be clamped by the first and second holding portions. Therefore, the base portion of the wedge base bulb is supported at two points, i.e., by the first holding portions and the second holding portions, thus making the holding reliable.

The base portion of the wedge base bulb is Clamped by way of two-point support implemented on the front end side and on the rear end side in terms of the insertion direction in holding the wedge base bulb. Therefore, the invention can provide the excellent advantages that the bulb holding force of the bulb socket is improved and the impact resistance thereof is increased as well. In addition, the bulb socket can be formed of a sheet metal having a predetermined thickness without using expensive specially shaped members.

DETAILED DESCRIPTION OF PREFERRED EMBODIMENTS

Figure 1:
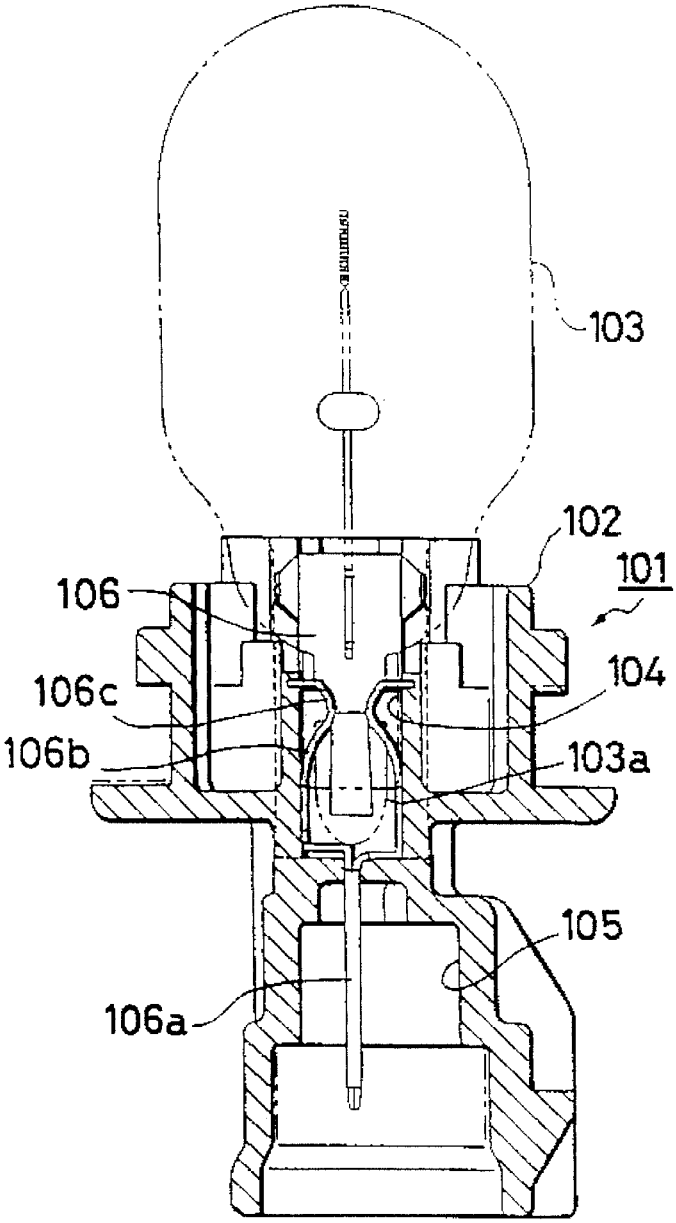
FIG. 1 PRIOR ART
FIG. 1 is a side sectional view showing a conventional bulb socket and a conventional wedge base bulb.
Figure 2:
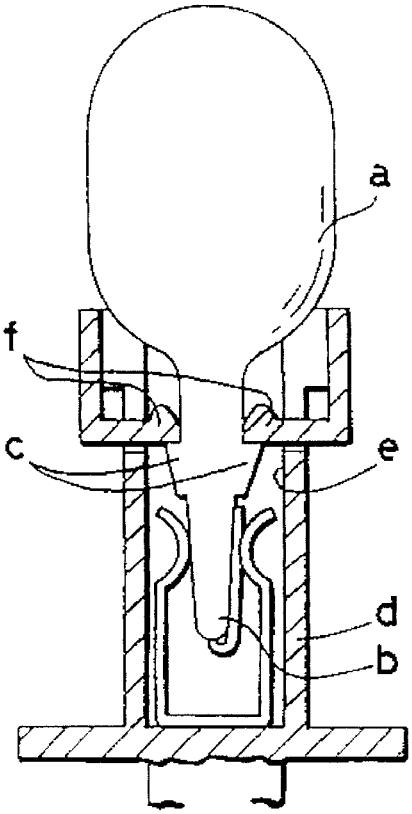
FIG. 2 PRIOR ART
FIG. 2 is a diagram illustrative of a conventional bulb socket and a conventional wedge base bulb.
Figure 3:
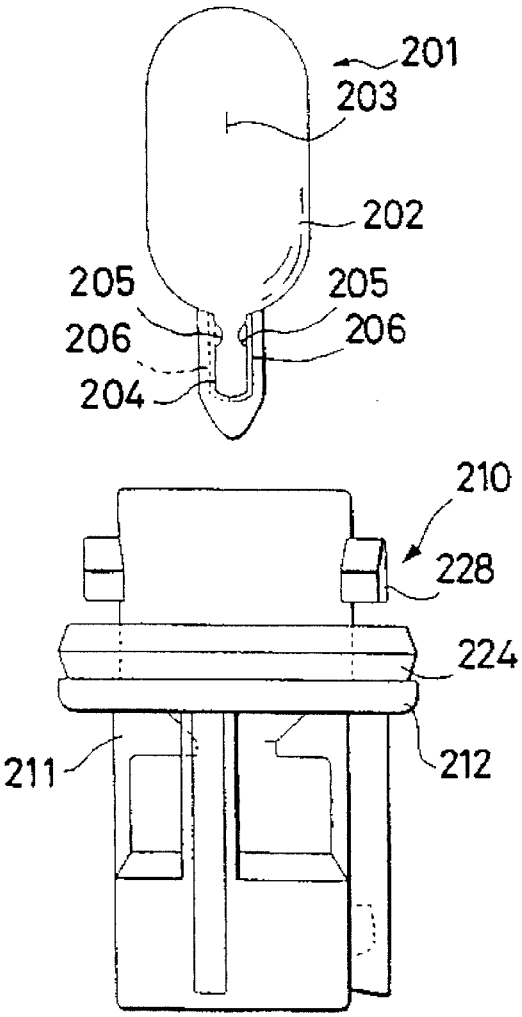
FIG. 3 is a front view showing the external appearance of a bulb socket, which is a first embodiment of the device, and of a bulb.

Embodiments of the device will now be described with reference to FIGS. 3 to 12. FIGS. 3 to 6 show a first embodiment, which exemplifies a bulb socket to which a small-sized wedge base bulb is attached.

The wedge base bulb 201 has an elongated filament 203, sealed glass bulb 202, and a plate-like wedge base 204 integrally extends on the end side thereof. A longitudinally extending cylindrical portion bulges out in a central portion of the base 204, although not shown in the drawing in detail. Horizontally extending grooves 205 are formed on both front and back surfaces of the base 204 excluding the cylindrical portion. Each horizontally extending groove 205 is substantially semicircular in section. A pair of leads extend from the bottom end surface of the base 204. One of the leads is folded back so as to extend along the front surface of the base 204, and the other is also folded back so as to extend along the back surface of the base 204, both up to such a position as to intersect the horizontally extending grooves 205, respectively.

On the other hand, a socket main body 211 of the bulb socket 210 is formed into a substantially cylindrical part. A collar 212 is formed so as to project from the entire circumference in the middle of the outer surface of the socket main body 211. Inside the socket main body 211 is a partition wall 213, which stands up to a position slightly lower than the level that corresponds to the collar 212. The partition wall 213 divides the inner space of the socket main body 211 into upper and lower chambers. The upper chamber is a bulb holding chamber 215 that contains the bulb 201, and the lower chamber is a connector insertion chamber 216 into which a female connector (not shown) is inserted.

Figure 4:
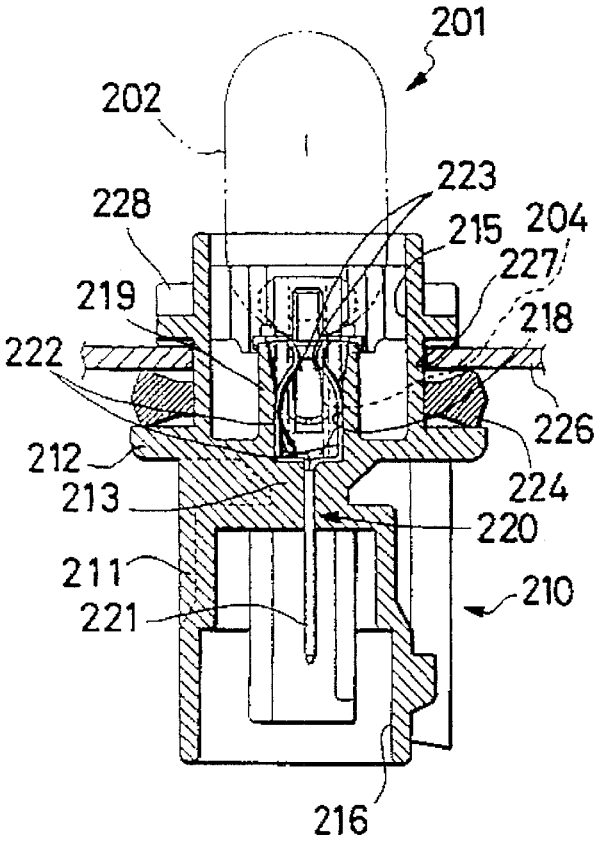
FIG. 4 is a sectional view of the bulb socket, which is the first embodiment, mounted on a mounting plate.
Figure 5:
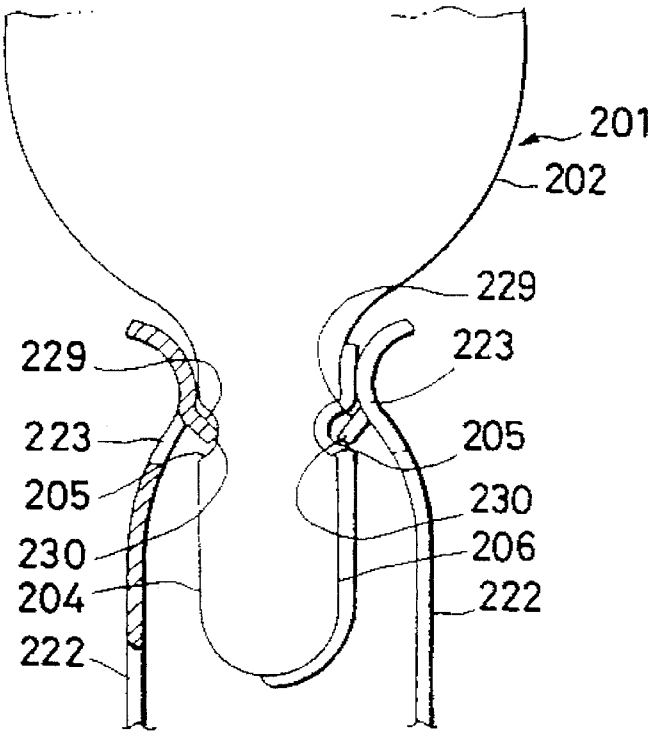
FIG. 5 is a partially enlarged front view showing a detail of a clamping portion according to the first embodiment.
Figure 6:
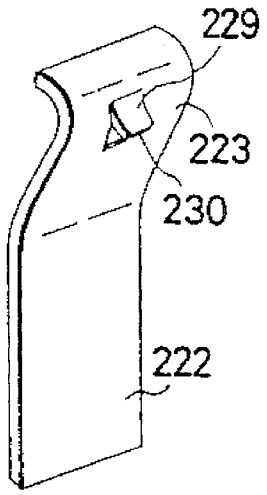
FIG. 6 is a perspective view of a bulb clamping piece according to the first embodiment.

On the bottom surface of the bulb holding chamber 215, a pair of symmetrically confronting projected walls 219 are erected. An insertion groove 218 is interposed between these projected walls 219 so that the base portion 204 can be received therein. Two terminal fittings 220 are juxtaposed inside the insertion groove 218 so as to correspond to the two extremities of the base 204 in the width direction (only one of the terminal fittings 220 is shown in FIGS. 4 and 5). Each of the terminal fittings 220 is composed of a pair of bulb clamping pieces 222 and a male terminal piece 221. The pair of bulb clamping pieces 222 confront each other so that the base portion 204 of the bulb 201 can be clamped from both left and right sides thereof. The male terminal piece 221 extends downward integrally from the bulb clamping pieces 222 and projects into the connector chamber 216 while passing through the partition wall 213. In addition, each terminal fitting 220 is provided with a retaining means (not shown), so that the terminal fittings 220 are incorporated into the socket main body 211 so as not to be detached therefrom. Further, clamping portions 223 are formed on the upper end sides of both bulb clamping pieces 222 by bending the bulb clamping pieces 222 in gentle curves toward the horizontally extending grooves 205 of the base 204. As shown in FIG. 6, what is particularly characterized is that the respective clamping portions 223 are provided with projected pieces 229. The respective projected pieces 229 have the lower end portions thereof cut and raised obliquely inward, so that the edges of the thus cut and raised lower end portions constitute edges 230. The edges 230 are abutted against the horizontally extending grooves 205 from above in an oblique direction. As a result, the edges 230 are caught by the leads 206 that go along the horizontally extending grooves 205 so as to bite into the leads 206.

It should be noted that the socket main body 211 is designed to be mounted while sealed in such a manner that the bulb holding chamber 215 side of the socket main body 211 is inserted into a mounting hole 227 formed on a mounting plate 226 from the back after a gasket 224 has been set on top of the collar 212 and then with a mounting projection 228 retained by the opening edge of the mounting hole 227 while rotated by a predetermined angle, as shown in FIG. 4. The mounting projection 228 projects from the outer circumference of the bulb holding chamber 215.

A mode of operation and effect of the thus constructed bulb socket, which is the first embodiment of the device, will be specifically described next when the base 204 side of the bulb 201 is inserted into the bulb holding chamber 215 of the socket main body 211, the base 204 causes the respective bulb clamping pieces 222,222 to expand against the resiliency. As the base 204 is pushingly inserted into the insertion groove 218, the base 204 reaches the deepest end of the insertion groove 218 and the horizontally extending grooves 205 thereby correspond to the clamping portions 223 of the bulb clamping pieces 222. At that instant, with the upper end sides of the bulb clamping pieces 222 being swung inward due to the restitutive force, the clamping portion 223 of one of the pair of the bulb clamping pieces 222 is fitted into the corresponding horizontally extending groove 205 by biasing the corresponding lead 206, whereas the clamping portion 223 of the other bulb clamping piece 222 is fitted into the horizontally extending groove 205 on the back, thereby allowing the base 204 to be clamped therebetween.

As shown in FIG. 5 in detail, the edges 230 that are the distal ends of the projected pieces 229 arranged on the clamping portions 223 of the bulb clamping pieces 222 bite into the leads 206 from above in an oblique direction and are caught by the leads 206 so as to reliably prevent the bulb 201 from being detached from the socket main body in the upward direction.

Figure 7:
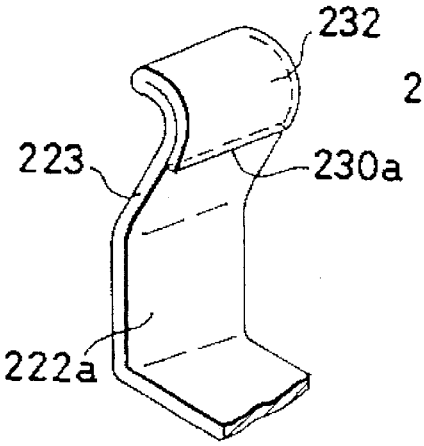
FIG. 7 is a perspective view of a bulb clamping piece according to a second embodiment.

FIG. 7 shows a second embodiment of the invention. The second embodiment is characterized as forming an edge 230*a* by extending the upper end side of a bulb clamping piece 222*a* upward in advance and folding back the extended portion up to the middle of the clamping portion 223 to form a folded piece 232 so that the end edge of the folded portion bites into the corresponding lead 206. Other aspects of the structure, mode of operation, and effect of the second embodiment are the same as those of the first embodiment.

Figure 8:
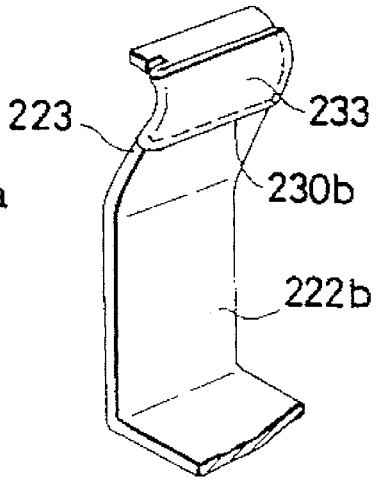
FIG. 8 is a perspective view of a bulb clamping piece according to a third embodiment.

FIG. 8 shows a third embodiment of the invention. The third embodiment is characterized as forming an edge 230*b* by forming a portion extended from one side edge on top of the clamping portion 223 of a bulb clamping piece 222*b* in advance and having the extended portion folded back on the upper half of the clamping portion 223 to form a folded piece 233 so that the lower end edge of the folded piece 233 bites into the corresponding lead 206. Other aspects of the structure, mode of operation, and effect of the third embodiment are the same as those of the first embodiment.

Figure 9:
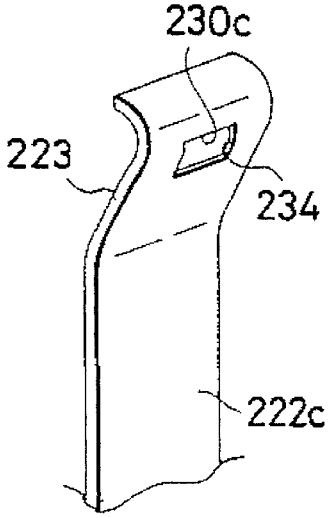
FIG. 9 is a perspective view of a bulb clamping piece according to a fourth embodiment.

FIG. 9 shows a fourth embodiment of the invention. The fourth embodiment is characterized as forming an edge 230*c* by arranging a window opening 234 in the clamping portion 223 of a bulb clamping piece 222*c* so that only the upper edge 230*c* out of the opening edges of the window opening 234 bites into the corresponding lead 206. The fourth embodiment can provide the same mode of operation and effect.

Figure 10:
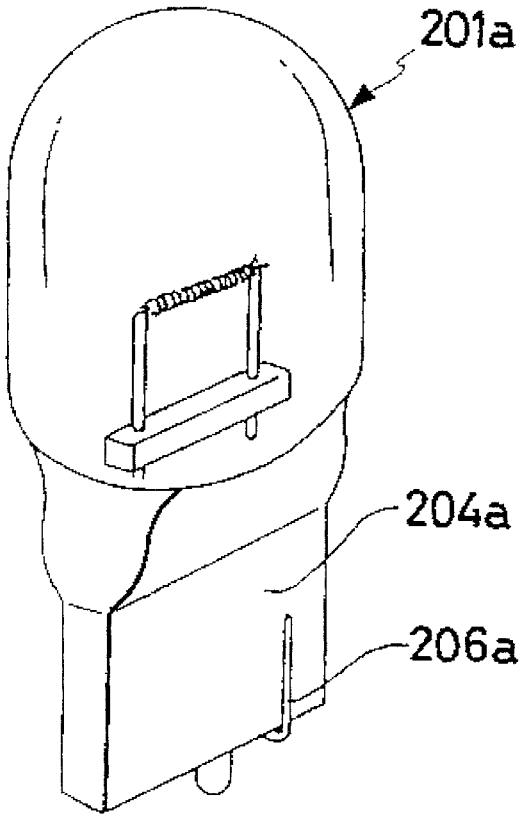
FIG. 10 is a perspective view of a bulb according to a fifth embodiment.
Figure 11:
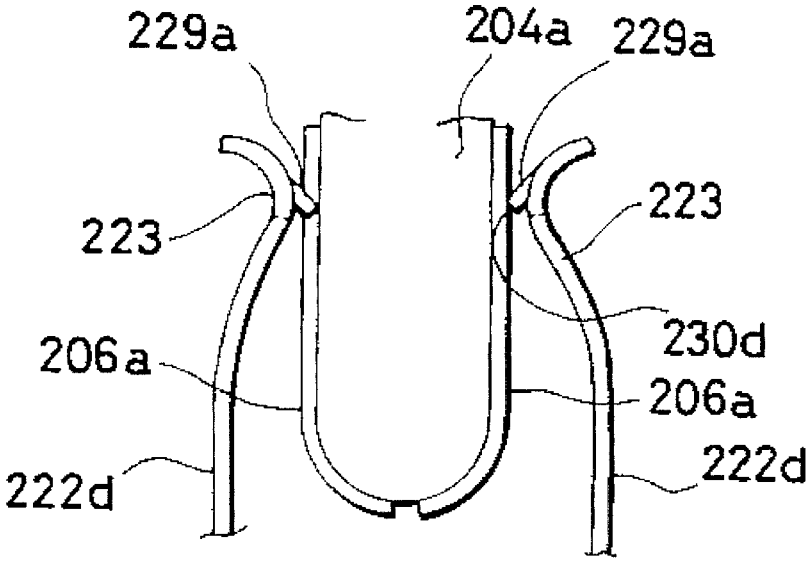
FIG. 11 is a diagram illustrative of a bulb clamping piece according to the fifth embodiment.

FIGS. 10 and 11 show a socket bulb, which is a fifth embodiment of the invention, to which a large-sized wedge base bulb is attached.

A large-sized wedge base bulb 201*a* is basically the same as the small-sized wedge base bulb except that the entire front and back surfaces of the wedge base 204 to be clamped are flat.

For the wedge base bulb 201*a*, a projected piece 229*a* is formed on the clamping portion 223 extended from each bulb clamping piece 222*d* by cutting and raising the lower end side obliquely outward as shown in FIG. 11 in a manner similar to that of the first embodiment, so that the distal end of the projected piece 229*a* functions as an edge 230*d* to bite into a corresponding lead 206*a*. As a result, the projected pieces 229*a* contribute to preventing the wedge base bulb la from being detached from this bulb socket.

Further, bulb sockets characterized as forming a folded piece on the clamping portion of each bulb clamping piece and using the end edge of the folded piece as an edge as in the second and third embodiments may also be applied to the large-sized wedge base bulb.

Figure 12:
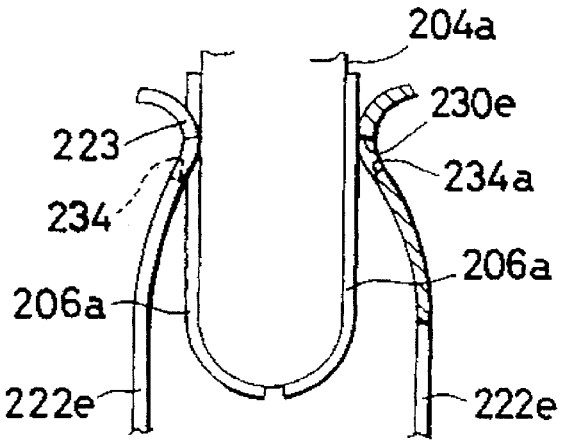
FIG. 12 is a diagram illustrative of a bulb clamping piece according to a sixth embodiment.

Still further, in the bulb socket of such type that the clamping portion of each bulb clamping piece has a window opening as in the fourth embodiment, it is desirable that the upper edge of a window opening 234*a* is located in the most largely bulged portion of a bulb clamping piece 222*e* as shown in FIG. 12 which is the sixth embodiment, so that the upper edge of the window opening 234*a* serves as an edge 230*e* to bite into the corresponding lead 206*a* to prevent the bulb from being detached from the bulb socket.

A seventh embodiment of the invention will now be described in detail with reference to FIGS. 13 to 16C.

Figure 13:
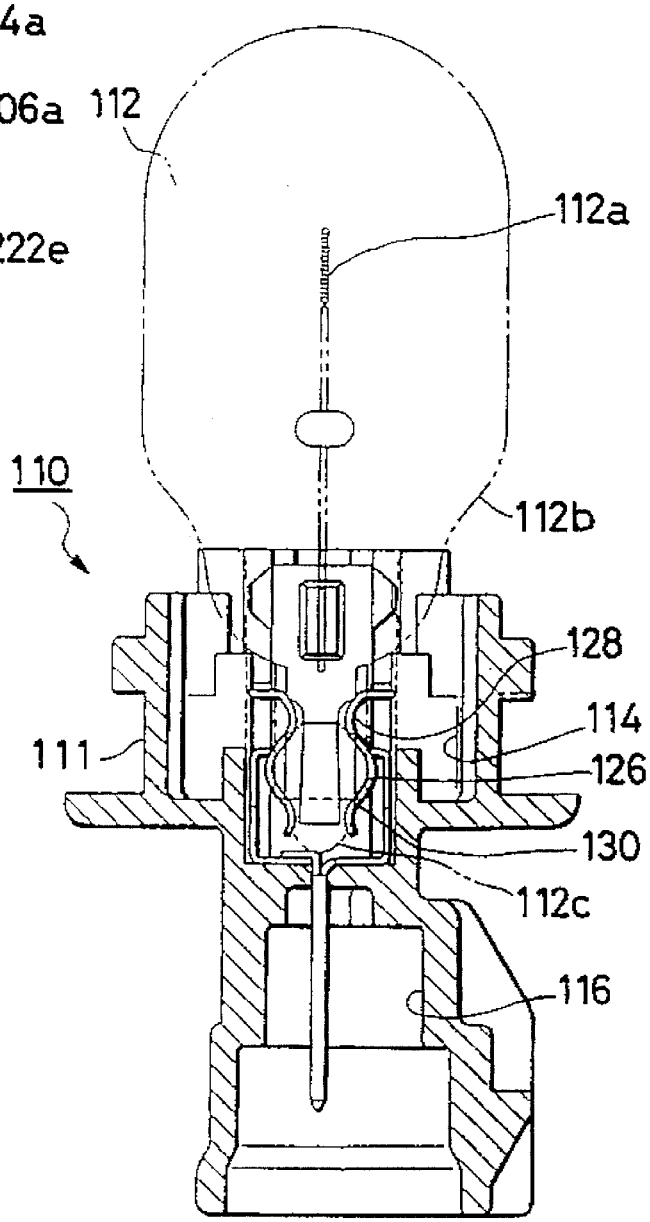
FIG. 13 is a side sectional view of a bulb socket to which a wedge base bulb is attached, according to a seventh embodiment.

A bulb socket 110 shown in FIG. 13 is designed to hold a single filament type wedge base bulb 112. The wedge base bulb 112 has a flat base portion 112*c* formed integrally therewith on a lower portion of a bulb portion 112*b* containing a filament 112*a* therein. Two leads extended from the lower surface of the base portion 112*c* are folded back toward both left and right sides of the base portion to form power supply terminals.

Figure 15A:
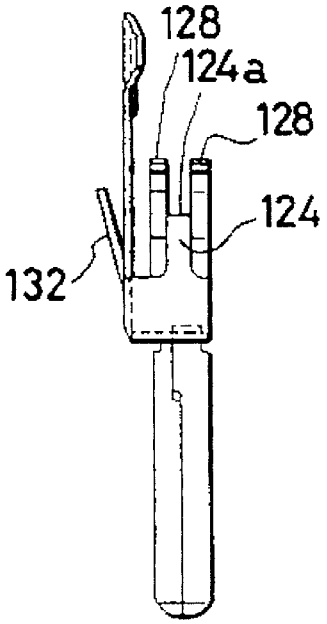
FIG. 15A is a side view of a holding metal.
Figure 15B:
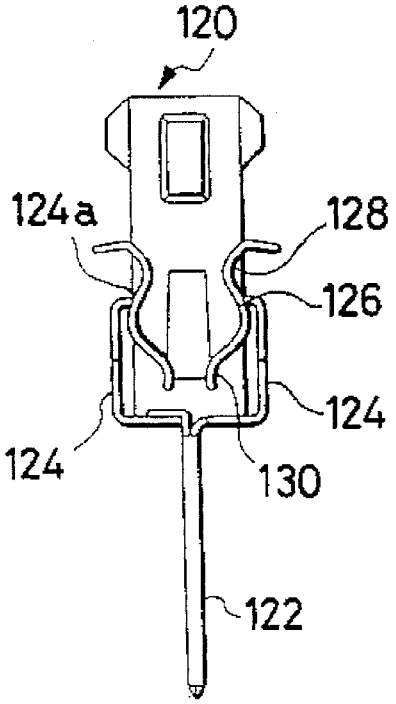
FIG. 15B is a front view of the holding metal.

The main body 111 of the bulb socket 110 is substantially cylindrical in structure and made of a synthetic resin material. A bulb insertion hole 114 into which the base portion 112*c* of the wedge base bulb 112 is inserted and a connector insertion hole 116 that allows a not shown connector for conduction to be connected thereto are opened so as to face oppositely in the vertical direction. A pair of holding metals 20 such as shown in FIGS. 15A and 15B are provided on the socket main body 111. These holding metals 120 serve the functions of supplying power to the wedge base bulb 112 as well as keeping the wedge base bulb 112 from being detached from the bulb main body 111.

As shown in FIGS. 15A and 15B, each holding metal 120 is formed by bending a metal sheet made of an electrically conducting heat-resistant copper alloy, and has a terminal 122 at the lower portion thereof so as to be connected to the connector (not shown). Symmetrically bifurcated support portions 124 are formed on the terminal 122. Each support portion 124 is slitted at two lateral positions and bent inward. Holding pieces 126 that are swingable with the bent portion 124*a* of each support portion 124 as the center of swing, are formed integrally with each support portion 124. To form the holding pieces 126, the slitted portions at the two lateral positions of each support portion 124 are also bent integrally with the holding pieces 126. First holding portions 128 that are similarly bent inward are arranged at the upper portions of the holding pieces 126. In addition, second holding portions 130 that are similarly bent are arranged at the lower portions of the holding pieces 126. The holding pieces 126 are opened apart upward with the distance between the second holding portions 130 being narrower than the distance between the first holding portions 128. It is between the first holding portion 128 and the second holding portion 130 that the bent portion 124*a* serving as the center of swing is located. The distance between the second holding portions 130 increases as the base portion 112*c* of the wedge base bulb 112 is inserted and the distance between the first holding portions 128 decreases as the holding pieces 126 are swung around the center of swing. It should be noted that a pawl piece 132 is arranged on the rear side in the middle of each holding metal 120. The pawl pieces 132 keep the wedge base bulb from being detached when the wedge base bulb is inserted into the bulb socket 110.

Figure 14:
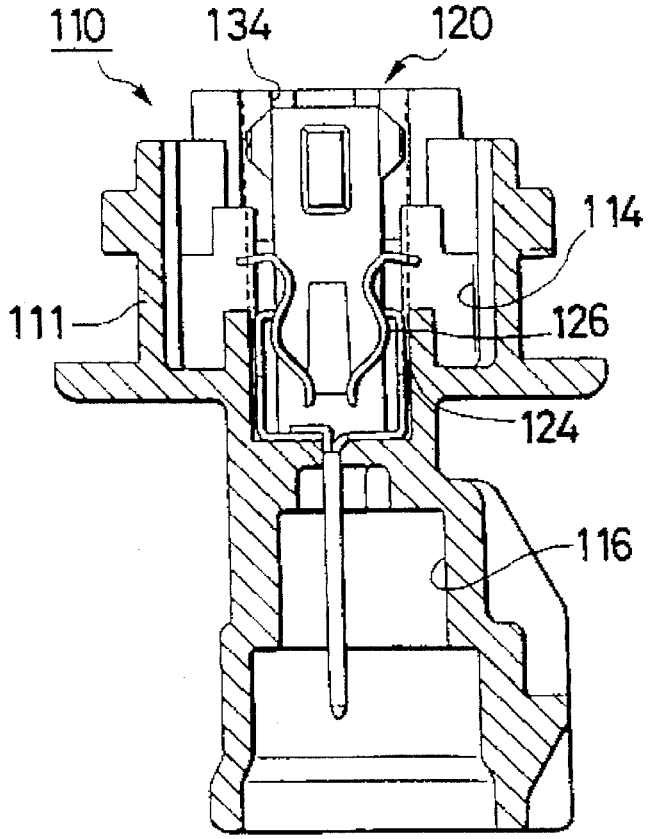
FIG. 14 is a side sectional view of the bulb socket according to a seventh embodiment.

As shown in FIG. 14, the holding metals 120 are inserted into a pair of insertion grooves 134 arranged at positions at which side walls of the bulb insertion hole 114 of the socket main body 111 confront each other, and the terminal 122 projects toward the connector insertion hole 116. The holding metals 120 are undetachably locked as the pawl pieces 132 are engaged with engagement portions (not shown) arranged within the insertion grooves 134. When the holding metals 120 are attached to the socket main body 111 in this way, the holding pieces 126 supported by the support portions 124 are set at positions inside the bulb insertion hole 114 into which the base portion 112*c* of the wedge base bulb 112 is inserted.

A procedure for attaching the wedge base bulb 112 to the thus constructed bulb socket 110 will be described next.

Figure 16A:
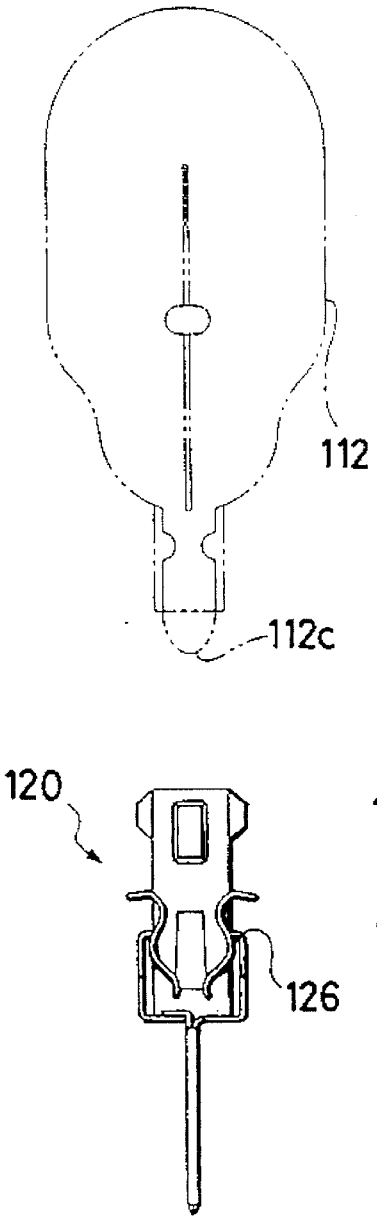
FIG. 16A is a side view before insertion.
Figure 16B:
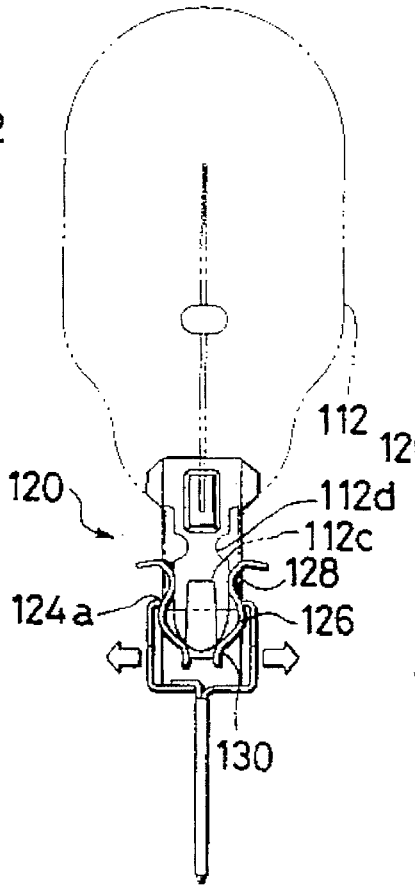
FIG. 16B is a side view at the time the wedge base bulb is half inserted into the holding metal.
Figure 16C:
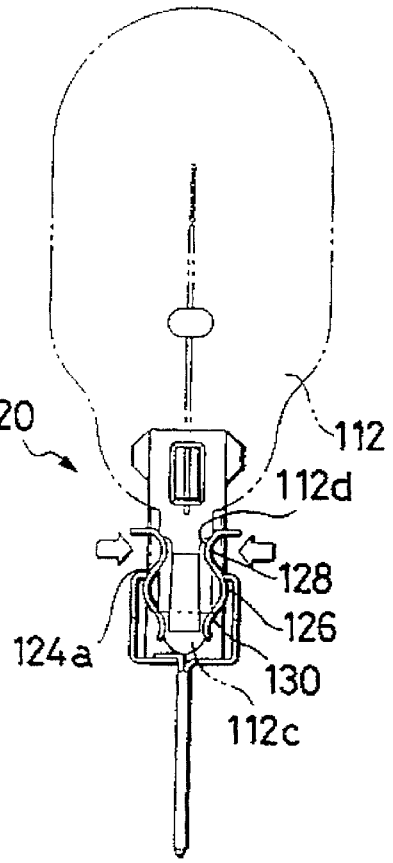
FIG. 16C is a side view at the time the wedge base bulb is completely inserted into the holding metal.

As shown in FIG. 16A, the base portion 112*c* of the wedge base bulb 112 is caused to confront both the holding pieces 126 of each holding metal 120. Then, as shown in FIG. 16B, the base portion 112*c* is inserted into the first holding portions 128 of the holding pieces 126 of the holding metal 120. As a result, the first holding portions 128 clamp the rear side of base portion 112*c* in terms of the insertion direction. Since the front end of the base portion 112*c* in terms of the insertion direction starts to be inserted into the space between the second holding portions 130, the holding pieces 126 are swung with the bent portions 124*a* as the centers of swing, so that the distance between the first holding portions 128 starts decreasing. As the base portion 112*c* is further inserted, the front end of the base portion 112*c* in terms of the insertion direction enters into the space between the second holding portions 130 completely, so that the distance between the second holding portions 130 is expanded. As a result, the holding pieces 126 are swung with the bent portions 124*a* as the centers of swing as the distance between the second holding portions 126 is expanded, so that the distance between the first holding portions 128 is decreased, thus clamping a recessed portion 112*d* of the rear end of the base portion in terms of the insertion direction between the first holding portions 128. Accordingly, the base portion 112*c* is held more reliably by the holding pieces 126 of each holding metal 120 by way of two-point support implemented by the first holding portions 128 that are biased in such a direction as to narrow the distance therebetween and by the second holding portions 130 that are expanded.

As described in the foregoing, according to the seventh embodiment, the base portion 112*c* of the wedge base bulb 112 is held by way of two-point support implemented by the first holding portions 128 on the upper end side of the holding pieces 126 on the one hand and by the second holding portions 130 on the lower end side of the holding pieces 126 on the other, the holding pieces 126 being arranged so as to be swingable with the bent portions 124*a* of the support portions 124 of each holding metal 120 as the centers of swing. Therefore, the force for holding the wedge base bulb 112 is increased, thereby making the holding reliable. It is, therefore, particularly effective to apply this embodiment to lamps mounted close to the trunk compartment of an automobile to which a strong impact is applied, because this embodiment can improve impact-resistance.

In addition, the base portion can be held reliably by way of two-point support implemented by the first holding portions 128 and the second holding portions 130 of each holding metal 120, each of which has a certain plate thickness. Therefore, it is no longer necessary to use expensive specially shaped members to improve resiliency of the holding portions, which provides an advantage in terms of parts cost.

It should be noted that while the support portions 124 of the holding metal 120 and the holding pieces 126 are made of a metal sheet integrally and are connected by the bent portions 124*a*, the holding metal 120 may be formed, e.g., separately from the holding pieces 126, and both may be welded together so that the welded portion may serve as the center of swing.

What is claimed is:

1. A bulb socket for holding a wedge base bulb comprising:

a main body having a bulb holding chamber;

bulb clamping pieces extending in a first direction inside said bulb holding chamber, said clamping pieces clamping a base of a bulb and being connectable to leads extending on said base; and at least one projected piece formed on the bulb clamping pieces and extending in a second direction that is substantially perpendicular to said first direction, the at least one projected piece having an edge transverse to the first and second directions for engaging a surface of the leads, said edge biting into the surface of the leads to prevent the bulb from falling out of the bulb holding chamber.

2. A bulb socket according to claim 1, wherein the edge is a distal end edge of said at least one projected piece cut out and raised from the bulb clamping pieces.

3. A bulb socket according to claim 1, wherein the edge is an end edge folded back on the bulb clamping pieces.

4. A bulb socket according to claim 1, wherein the edge is an edge of window openings formed in the bulb clamping pieces.

5. A bulb socket according to claim 1, wherein said edge is formed substantially even with a bent region of the bulb clamping pieces where the bulb clamping pieces contact said bulb.

6. A bulb socket for holding a wedge base bulb comprising:

a main body having a bulb holding chamber;

a holding member being electrically connected to a terminal including a pair of holding pieces for clamping a base portion of the wedge base bulb, each of said holding pieces having a first holding portion and a second holding portion extending in the direction of insertion of the base portion;

wherein each of the holding pieces has a pivoting axis between said first and second holding portions, each said pivoting axis being engageable with a further contact surface enabling pivoting of each of the holding pieces, and each of the second holding portions expands as the base portion of the wedge base bulb is further inserted into the bulb holding chamber.

7. A bulb socket for holding a bulb comprising:

a main body having a bulb holding chamber;

opposed bulb clamping pieces inside said bulb holding chamber, said bulb clamping pieces clamping a base of a bulb and being electrically connectable to leads of said bulb; and means for positively locking the bulb in the bulb holding chamber by engaging the leads with the clamping pieces to prevent the bulb from falling out of the bulb holding chamber, wherein said means for positively locking includes an edge that is folded back onto each of the bulb clamping pieces.

8. A bulb socket for holding a bulb comprising:

a main body having a bulb holding chamber;

opposed bulb clamping pieces inside said bulb holding chamber, said bulb clamping pieces clamping a base of a bulb and being electrically connectable to leads of said bulb; and means for positively locking the bulb in the bulb holding chamber by engaging the leads with the clamping pieces to prevent the bulb from falling out of the bulb holding chamber, wherein said means for positively locking includes a window opening formed on each of the bulb clamping pieces.

9. A bulb socket according to claim 8, wherein each said window opening includes an edge formed substantially along a bent portion of each of the bulb clamping pieces where the bulb clamping pieces contact said bulb.

* * * * *